US010611016B1

(12) United States Patent
Riley

(10) Patent No.: US 10,611,016 B1
(45) Date of Patent: Apr. 7, 2020

(54) COLLAPSIBLE PORTABLE VERSATILE SAFER COMBINATION SAW HORSE AND CLAMPING WORK BENCH WITH MITER SAW GUIDE APPARATUS

(71) Applicant: Joe Earl Riley, Sacramento, KY (US)

(72) Inventor: Joe Earl Riley, Sacramento, KY (US)

( * ) Notice: Subject to any disclaimer, the term of this patent is extended or adjusted under 35 U.S.C. 154(b) by 24 days.

(21) Appl. No.: 15/998,297

(22) Filed: Aug. 1, 2018

Related U.S. Application Data

(60) Provisional application No. 62/605,307, filed on Aug. 8, 2017.

(51) Int. Cl.

| | |
|---|---|
| ***B25H 1/06*** | (2006.01) |
| ***B25H 1/16*** | (2006.01) |
| ***B25H 1/10*** | (2006.01) |
| ***B25H 1/08*** | (2006.01) |

(52) U.S. Cl.
CPC ..... *B25H 1/06* (2013.01); *B25H 1/08* (2013.01); *B25H 1/10* (2013.01); *B25H 1/16* (2013.01)

(58) Field of Classification Search
CPC ... B25H 1/06; B25H 1/08; B25H 1/10; B25H 1/16; B23D 47/02; B23D 47/025
USPC .... 269/136, 16, 137, 138; 144/286.1, 286.5; 182/129, 153, 154; 83/734, 745
See application file for complete search history.

(56) References Cited

U.S. PATENT DOCUMENTS

| | | | | | |
|---|---|---|---|---|---|
| 2,958,873 | A * | 11/1960 | Ferneau | A61G 1/0567 | 108/117 |
| 4,073,484 | A * | 2/1978 | Beekenkamp | B25H 1/04 | 108/118 |
| 4,726,405 | A * | 2/1988 | Bassett | B23D 47/025 | 108/59 |
| 4,909,491 | A * | 3/1990 | Cheng | B25H 1/10 | 269/139 |
| 5,148,730 | A * | 9/1992 | McCaw | B23Q 9/0042 | 33/403 |
| 5,383,977 | A * | 1/1995 | Pearce | B25H 1/04 | 144/1.1 |
| 5,868,054 | A * | 2/1999 | Chubb | B27B 5/20 | 144/286.5 |
| 6,705,192 | B2 * | 3/2004 | Logan | B25H 1/04 | 144/286.5 |
| 6,769,674 | B2 * | 8/2004 | Chang | B25H 1/04 | 269/139 |
| 7,337,701 | B2 * | 3/2008 | Smith | B23D 47/025 | 83/435.11 |
| D565,320 | S * | 4/2008 | Wenskowski | D6/684 | |
| 7,448,608 | B2 * | 11/2008 | Radermacher | B25H 1/06 | 144/267 |
| 7,690,408 | B2 * | 4/2010 | Sugiura | B25H 1/16 | 144/286.5 |
| 7,926,523 | B2 * | 4/2011 | Williams | B25H 1/10 | 144/286.5 |
| 9,278,446 | B2 * | 3/2016 | Lifshitz | B25H 1/02 | |
| 10,093,017 | B2 * | 10/2018 | Birnbaum | B25H 1/0042 | |
| 2002/0108481 | A1 * | 8/2002 | Logan | B23D 47/025 | 83/471.3 |
| 2002/0166405 | A1 * | 11/2002 | Fortin | B25B 1/103 | 74/545 |
| 2003/0214088 | A1 * | 11/2003 | Chang | B25H 1/04 | 269/139 |

(Continued)

*Primary Examiner* — Orlando E Aviles
*Assistant Examiner* — Seahee Yoon

(57) ABSTRACT

A collapsible portable versatile saw horse and clamping work bench with miter saw guide.

4 Claims, 10 Drawing Sheets

(56) References Cited

U.S. PATENT DOCUMENTS

| | | | | |
|---|---|---|---|---|
| 2004/0065387 | A1* | 4/2004 | Smith | B23Q 3/007 144/253.1 |
| 2004/0250901 | A1* | 12/2004 | Ursell | B25H 1/04 144/286.1 |
| 2005/0051940 | A1* | 3/2005 | Bensman | B25H 1/04 269/139 |
| 2006/0038383 | A1* | 2/2006 | Wu | B25H 1/04 280/652 |
| 2008/0115701 | A1* | 5/2008 | Sugiura | B25H 1/04 108/132 |
| 2009/0007987 | A1* | 1/2009 | Thomas | B23D 47/025 144/286.1 |
| 2014/0363247 | A1* | 12/2014 | Clark | B23B 47/00 408/103 |

* cited by examiner

© 2018 Joe Earl Riley

© 2018 Joe Earl Riley

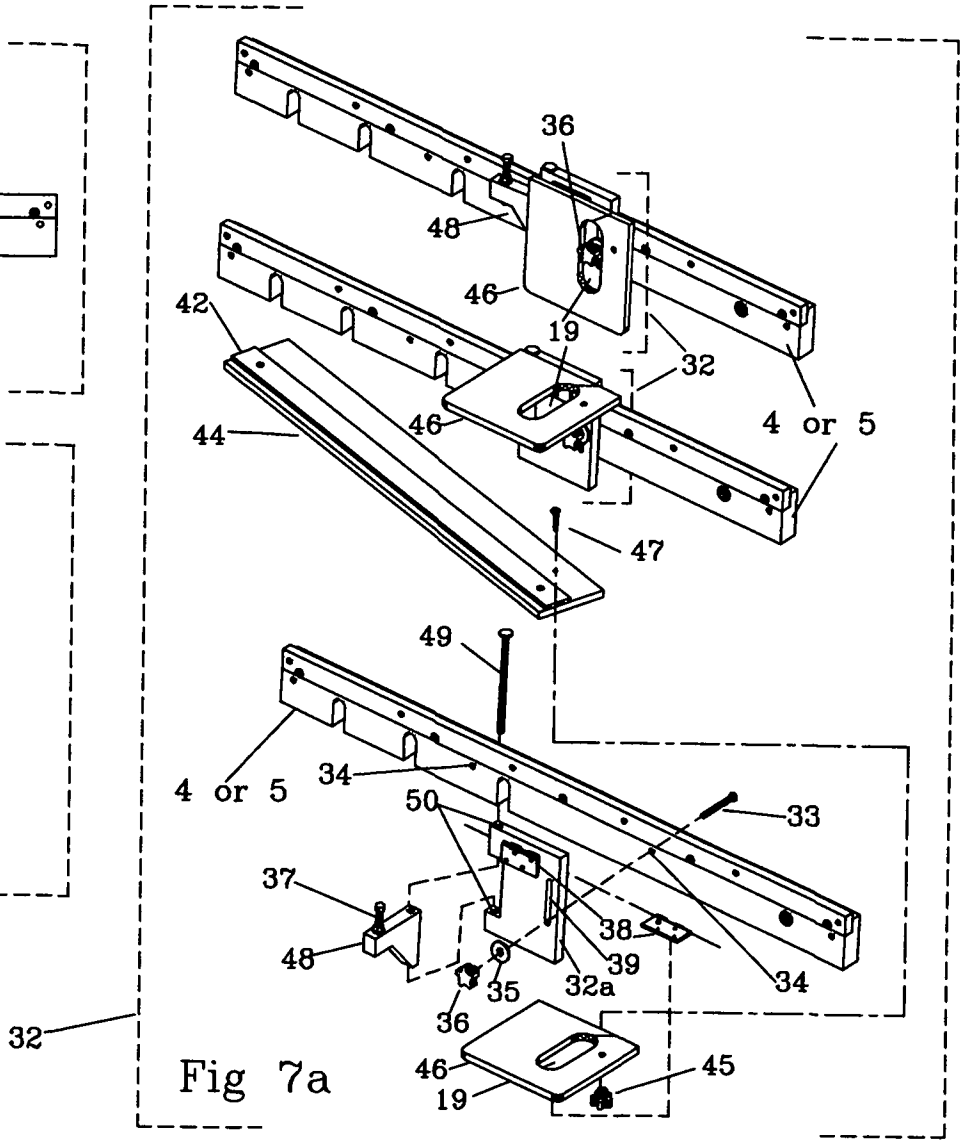
Fig 7a
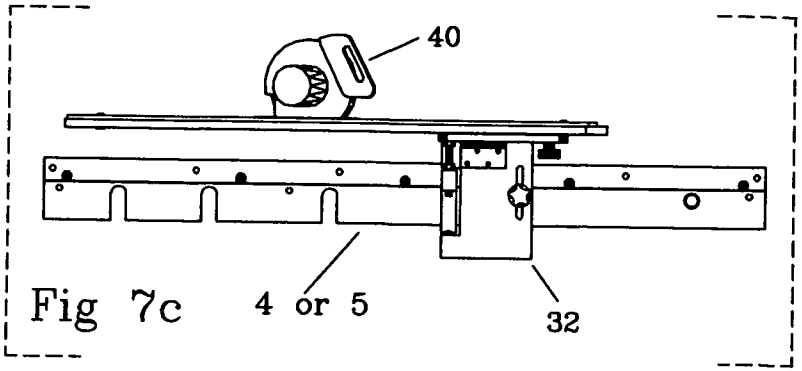
Fig 7c
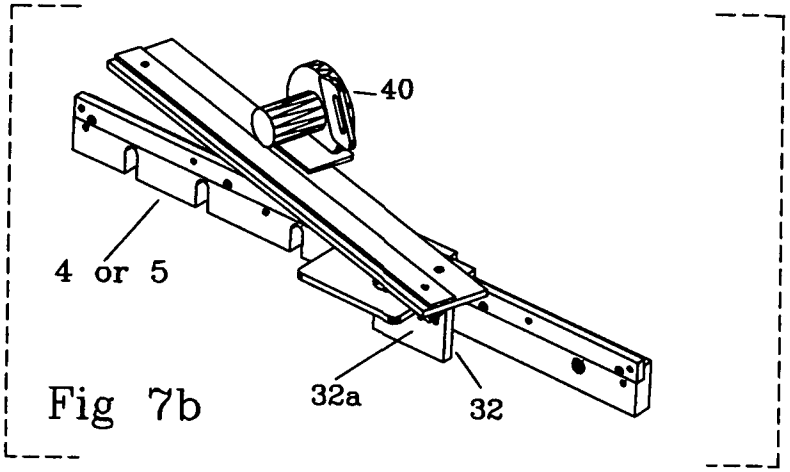
Fig 7b
Fig 7
© 2018 Joe Earl Riley

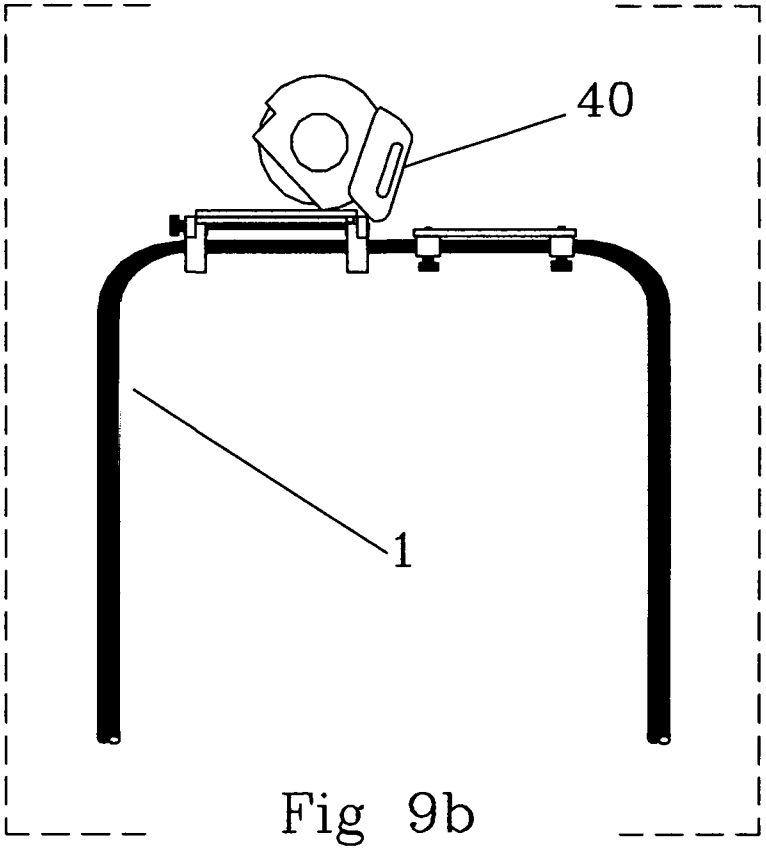
Fig 9b
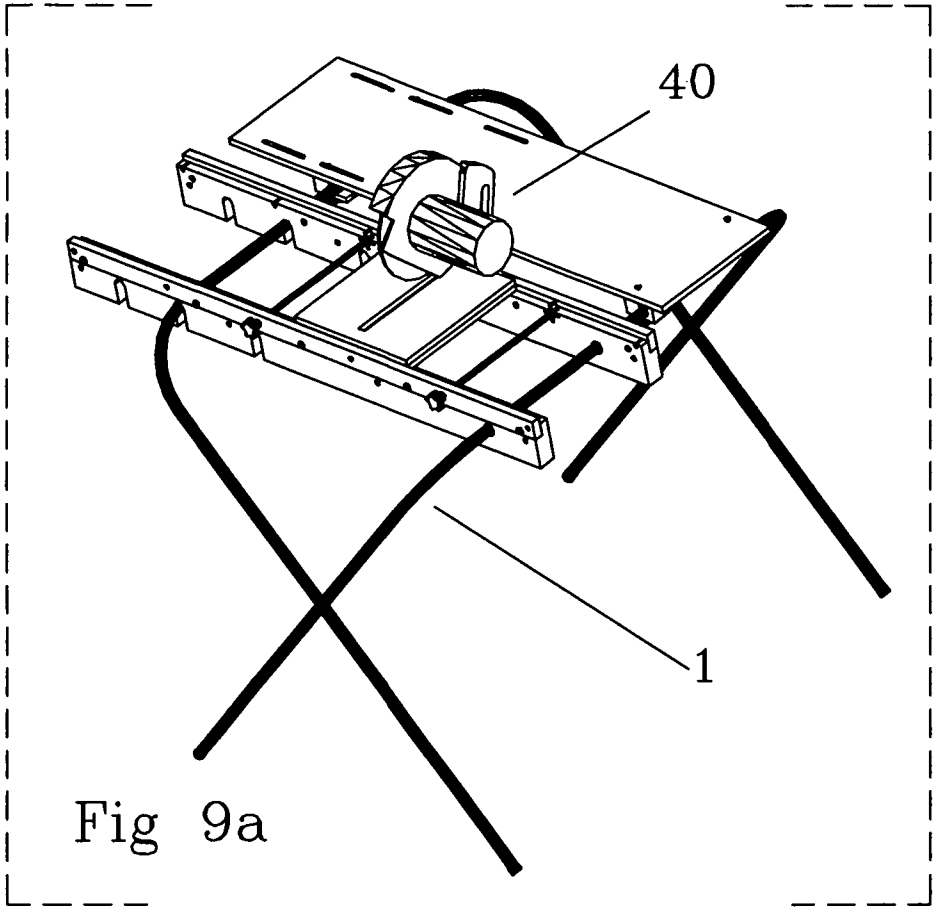
Fig 9a
Fig 9
© 2018 Joe Earl Riley

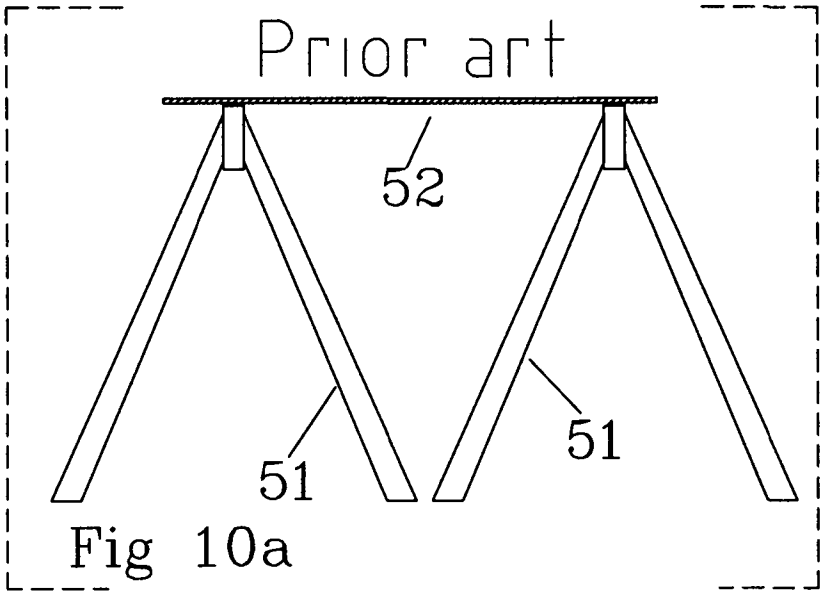
Fig 10a
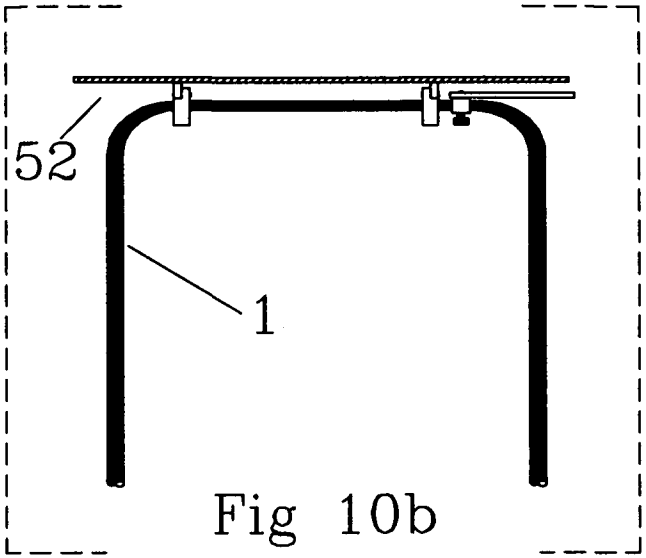
Fig 10b
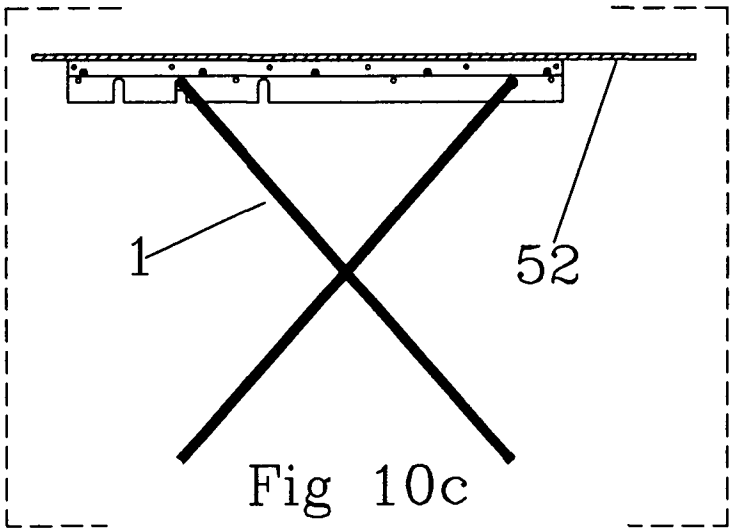
Fig 10c
Fig 10
© 2018 Joe Earl Riley

COLLAPSIBLE PORTABLE VERSATILE SAFER COMBINATION SAW HORSE AND CLAMPING WORK BENCH WITH MITER SAW GUIDE APPARATUS

CROSS REFERENCES TO RELATED APPLICATIONS

Provisional Application for Patent No. 62/605,307 filed Aug. 8, 2017 with the title: "Collapsible portable versatile safer saw horse apparatus" which is incorporated by reference. Applicant claims priority on material disclosed pursuant to 35 U.S.C. Par. 119(e)(i).

A portion of the disclosure of this patent document contains material which is subject to copyright protection. The copyright owner has no objection to the facsimile reproduction by any-one of the document or the patent disclosure, as it appears in the Patent and Trademark Office file or records, but otherwise reserves all copyrights whatsoever.

STATEMENTS AS TO RIGHTS TO INVENTIONS MADE UNDER FEDERALLY SPONSORED RESEARCH AND DEVELOPMENT

Not applicable

BACKGROUND OF THE INVENTION

1. Field of the Invention

This invention relates to a collapsible portable versatile combination saw horse and clamping work bench with miter saw guide useful to, but not restricted to, workers in the wood working industry, carpentry, electrical contracting and maintenance.

2. Background Information

In the wood working industry, wood workers such as, but not restricted to, carpentry shops and on site job sites, usually traditional wood saw horses are used. Portability, versatility, and safety are a problem.

As will be seen from the subsequent description of the preferred embodiments of the present invention, this present invention alleviates shortcomings of existing saw horses.

BRIEF SUMMARY OF THE INVENTION

In the preferred embodiment of the present invention, a collapsible portable versatile safer combination saw horse and clamping work bench with miter saw guide apparatus comprises collapsible support legs, clamping rail assemblies which provide for height of work platform adjustments, a saw guide for assisting angle cuts, thread clamp rods, clamp nuts, and work surfaces.

BRIEF DESCRIPTION OF THE SEVERAL VOWS OF THE DRAWINGS

Figure 1:
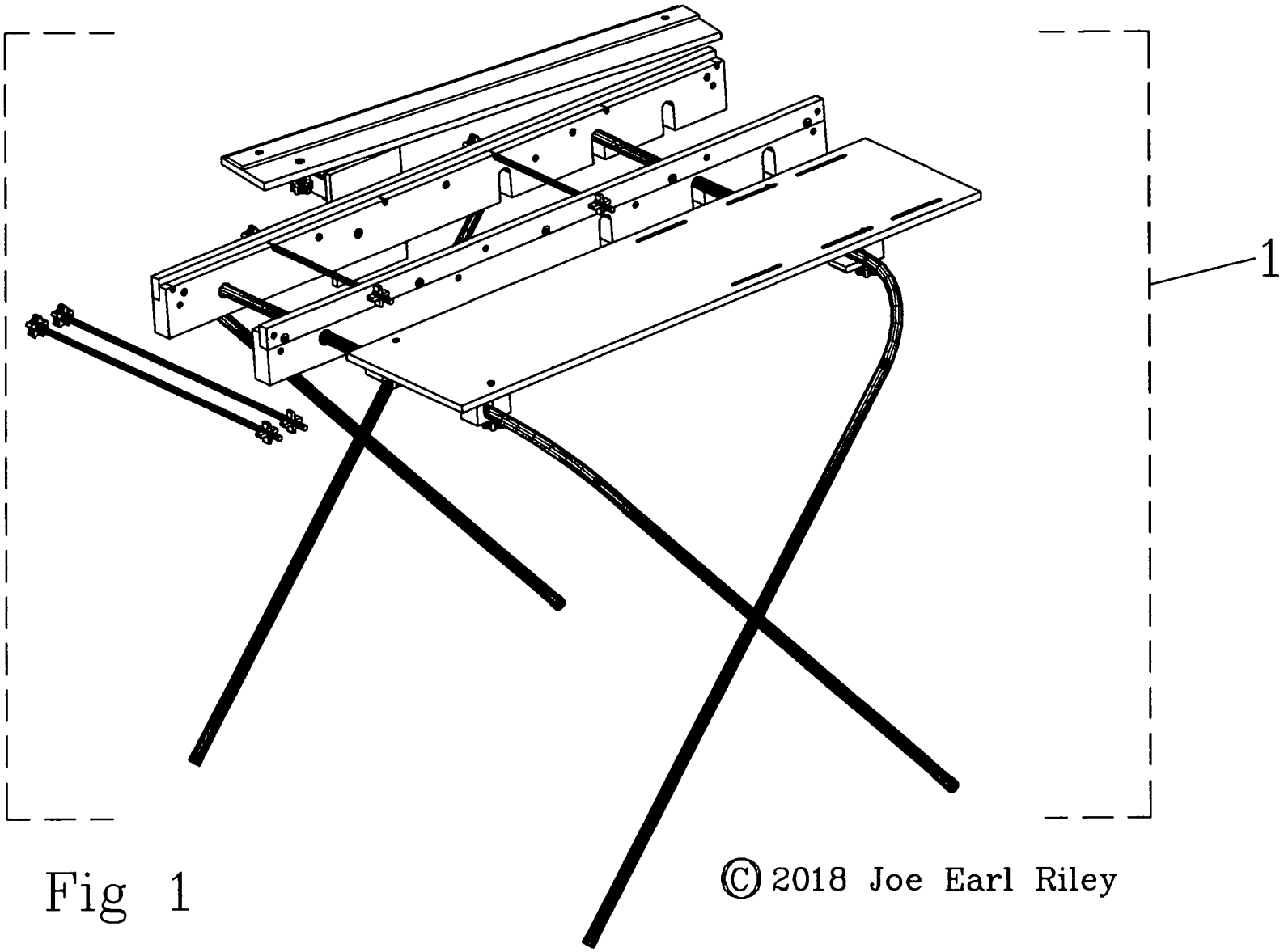
Figure 2:
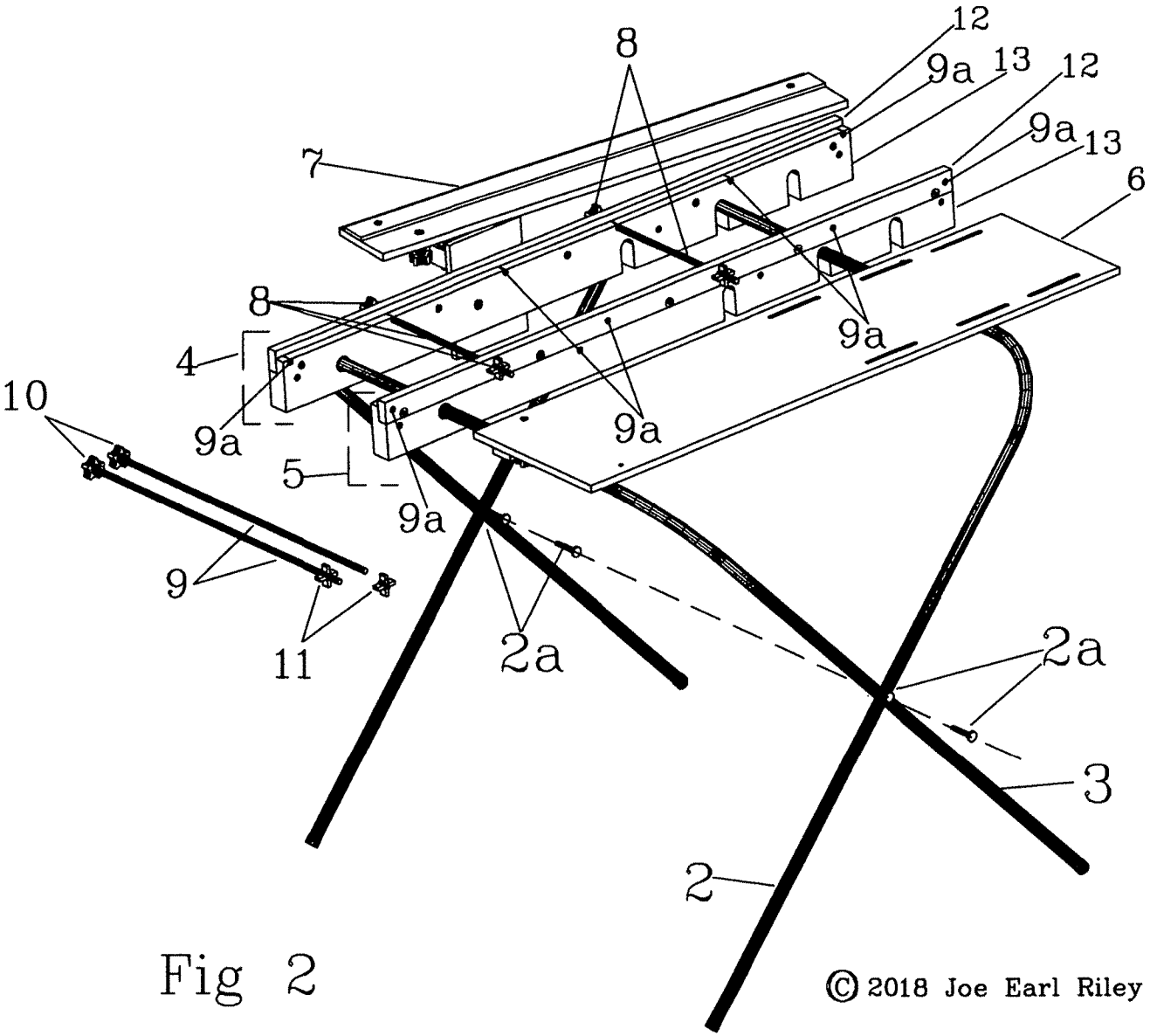

FIGS. 1 and 2 are isometric views of a saw horse portion of the preferred embodiment of the present invention.

Figure 3:
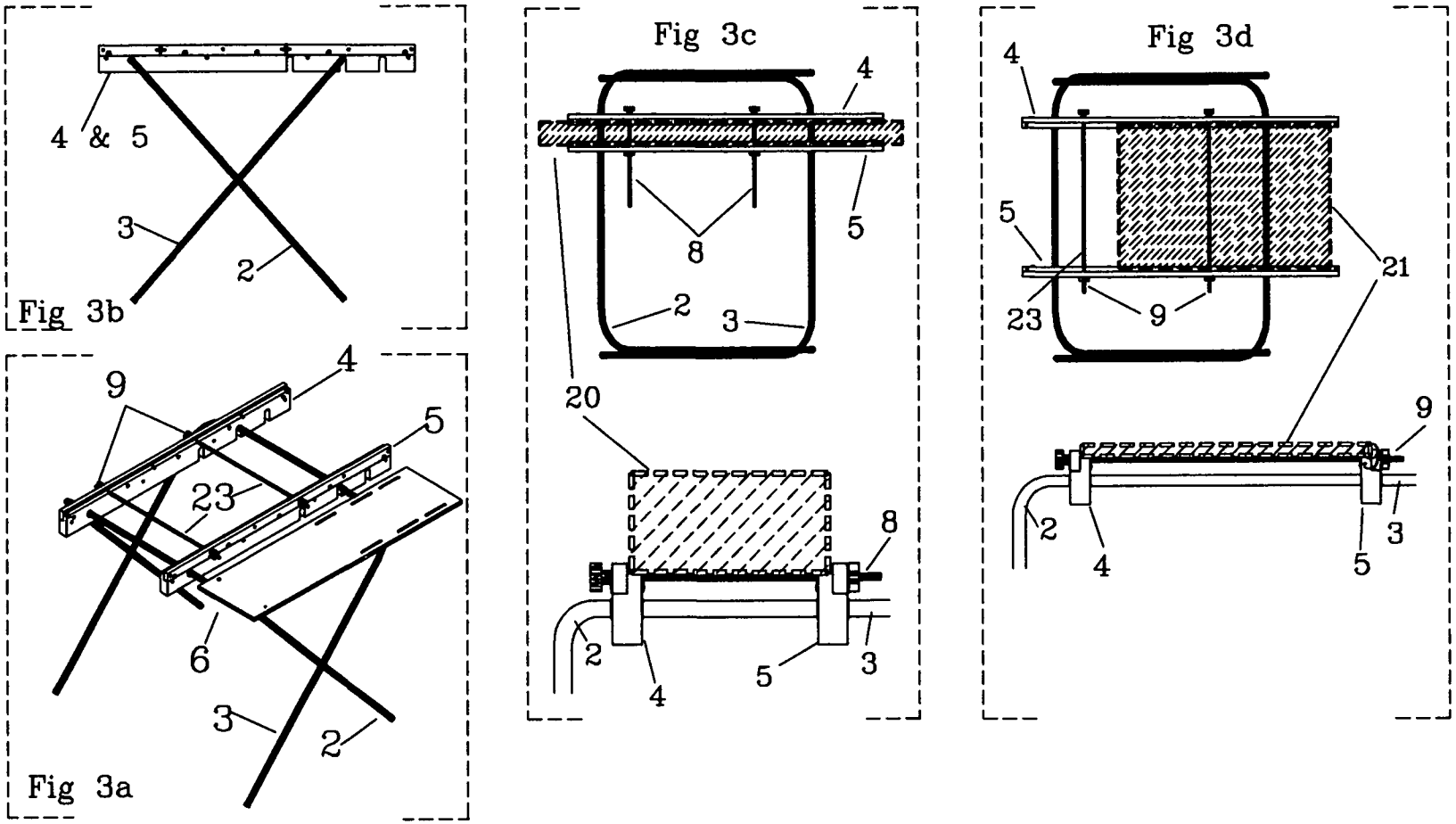

FIG. 3 comprises views illustrating clamping rail function.

Figure 4:
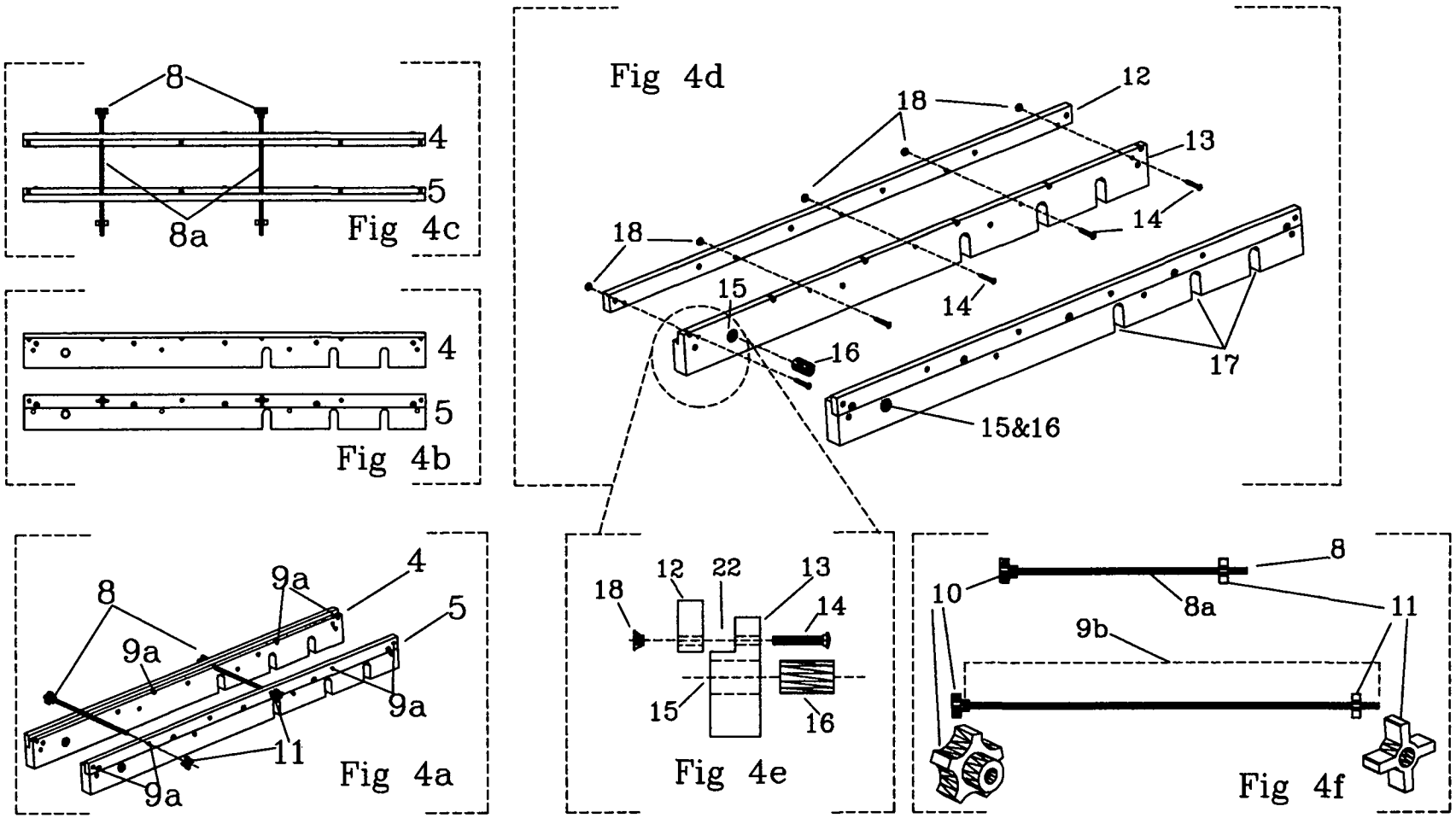

FIG. 4 comprises views of clamping rail details.

Figure 5:
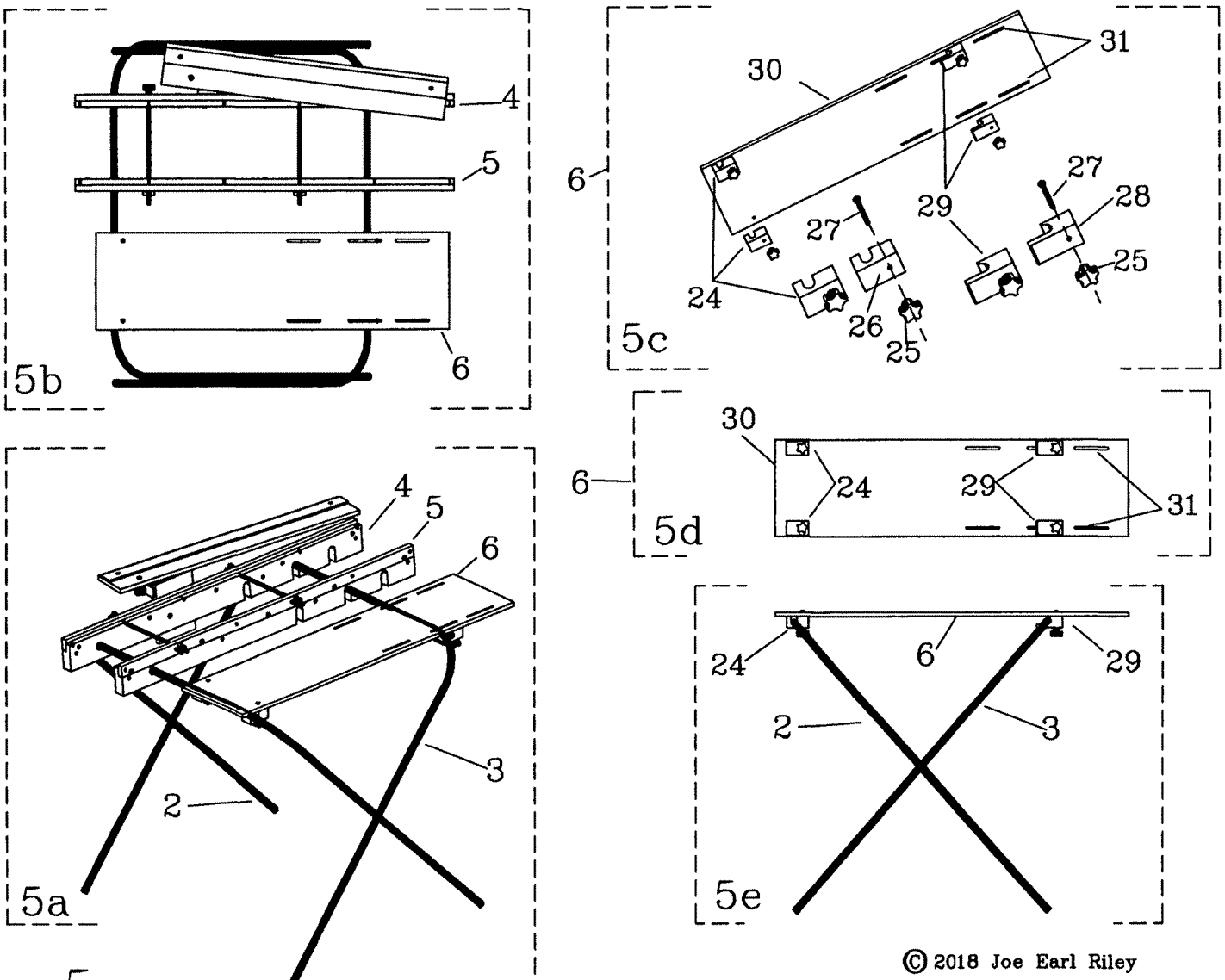
Figure 6:
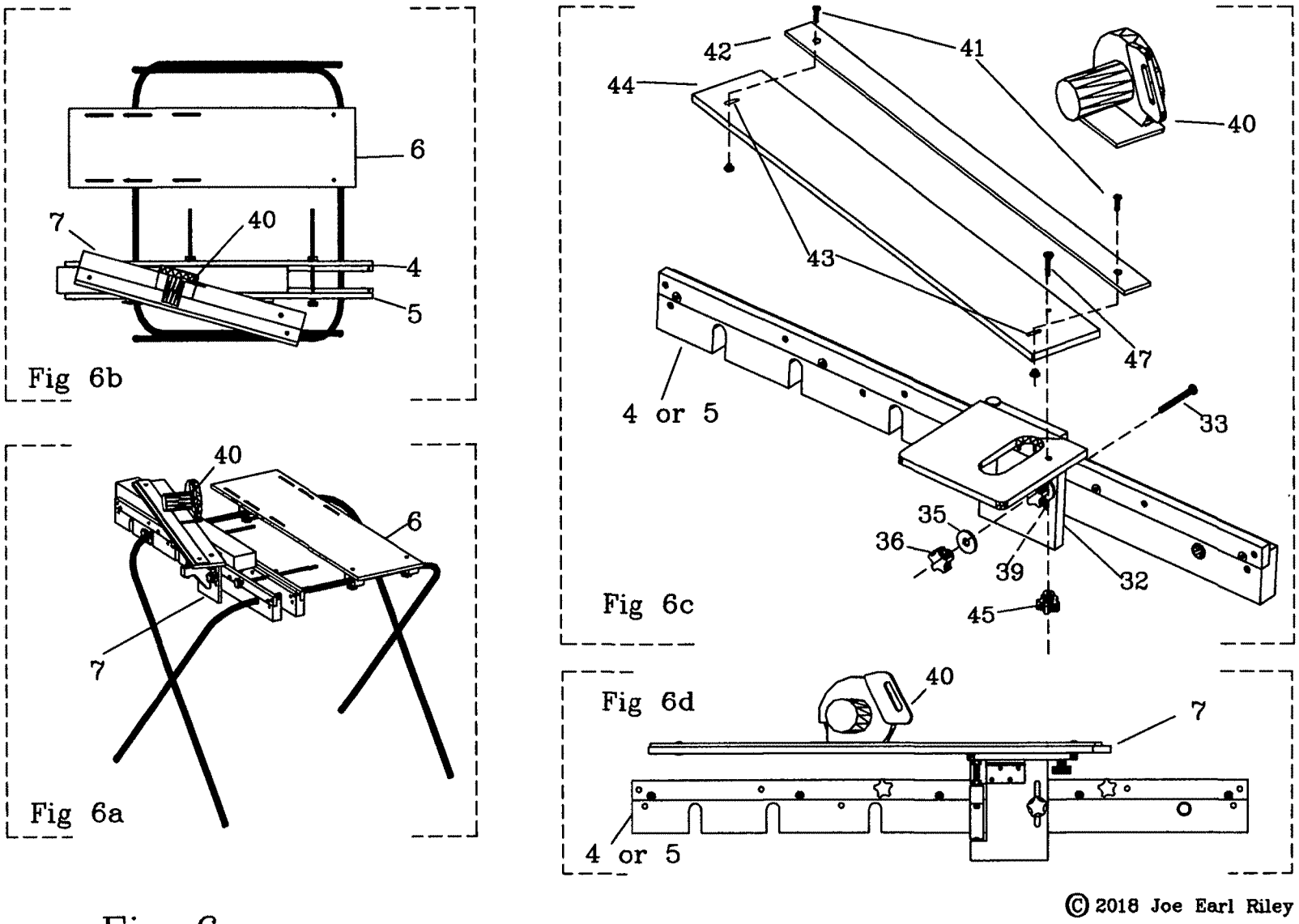

FIG. 5 comprises views of a safety support and work surface.

FIGS. 6 through 9 comprise views of a saw guide assembly.

FIG. 10 illustrates the support of a sheet of plywood by prior art versus the present invention.

DETAILED DESCRIPTION OF THE INVENTION

Referring to FIGS. 1 through 10, in the preferred embodiment of the present invention, a collapsible portable versatile safer combination saw horse and clamping work bench with miter saw guide apparatus 1 comprises pivoting support legs 2, 3, with pivot pin 2*a*, at least one pair of clamping rail assemblies 4, 5, a work surface assembly 6, an angle cutting miter saw guide assembly 7 for guiding a cutting device such as, but not restricted to, a saw 40 (Ref. FIG. 7*c*), and standard length all thread rod assemblies 8.

The clamping rail assemblies 4, 5 are manufactured as reverse images of each other.

The design of the clamping rail assemblies 4, 5, is such that they are replaceable and sacrificial in that they are intended to be cut into, drilled, ground, or sanded while holding a work piece in place. When the cutting rail assemblies 4, 5 reach the end of their safe and usable life, they can easily be replaced by an end user.

Referring both to FIG. 5 which comprises FIGS. 5*a*, 5*b*, 5*c*, 5*d*, and 5*e* as well as FIGS. 6*a* and 6*b*, the work surface assembly 6 comprises encompassing clamp assemblies 24, a knob 25, open end clamp assemblies 29, and a flat surface 30.

Each encompassing clamp assembly 24 comprises a hand turn knob 25, an encompassing clamp 26, and a clamp bolt 27.

Each open end clamp assembly 29 comprises the hand turn knob 25, the clamp bolt 27 and an open end clamp 28.

The flat surface 30 has slots 31 through which each open end clamp assembly 29 can be attached by means of the clamp bolts 27 and the hand turn knob 25. The slots 31 enable more precise height adjustments of the work surface assembly 6.

Referring to FIG. 5*c*, the encompassing clamp assembly 24 is shown encompassing the support leg 2 while the open end clamp assembly 29 enables the work surface assembly 6 to reduce working loading on the clamp rail assemblies 4, 5.

Referring to FIG. 7 which comprises 7*a*, 7*b*, and 7*c*, the angle cutting miter saw guide assembly 7 comprises a base assembly 32, an attachment bolt 33 which attaches the base assembly 32 to the clamping rail 5 through any one of apertures 34, in conjunction with a washer 35 and a hand tightening knob 36, a leveling bolt 37, saw guide attachment bolts 41 for attaching a saw guide 42 to a slide surface 44 for the saw 40, and an angular adjustment hand nut 45 which is used with an adjusting bolt 47 to adjust orientation the saw guide 42 with respect to the clamping rail assemblies 4, 5.

The slide surface 44 comprises slide slots 43 so as to permit placement of the slide guide 42 as required to adjust for a variety of saws 40.

The saw 40 slides on the slide surface 44, guided by the saw guide 42.

Referring to FIGS. 7*a* through 7*b*, the base assembly 32 comprises a base plate 32*a*, an attachment plate 46, a hinge 38 which connects the attachment plate 46 to the base plate 32*a* with pivot pin holes 50, a swing arm 48 which supports the angle cutting miter saw guide assembly 7, the leveling bolt 37 for leveling the attachment plate 46, a pivot pin 49 which goes through the pivot pin holes 50 to secure a swing arm 48, and a slot 39, through which the attachment bolt 33 which goes through one of the apertures 34 in either of in the guide rail assemblies 4, 5, and a washer 35 and a hand tightening knob 36, securing the attachment bolt 33 which passes through the slot 39.

The hinge 38 facilitates lifting of the angle cutting miter saw guide assembly 7 out of the way to quickly change a work piece (not shown).

The attachment plate 46 (Ref FIG. 7*a*) has a clearance 19 which precludes interference of the hand tightening knob 36 with the attachment plate 46 when the slide surface 44 is rotated upward.

Figure 8:
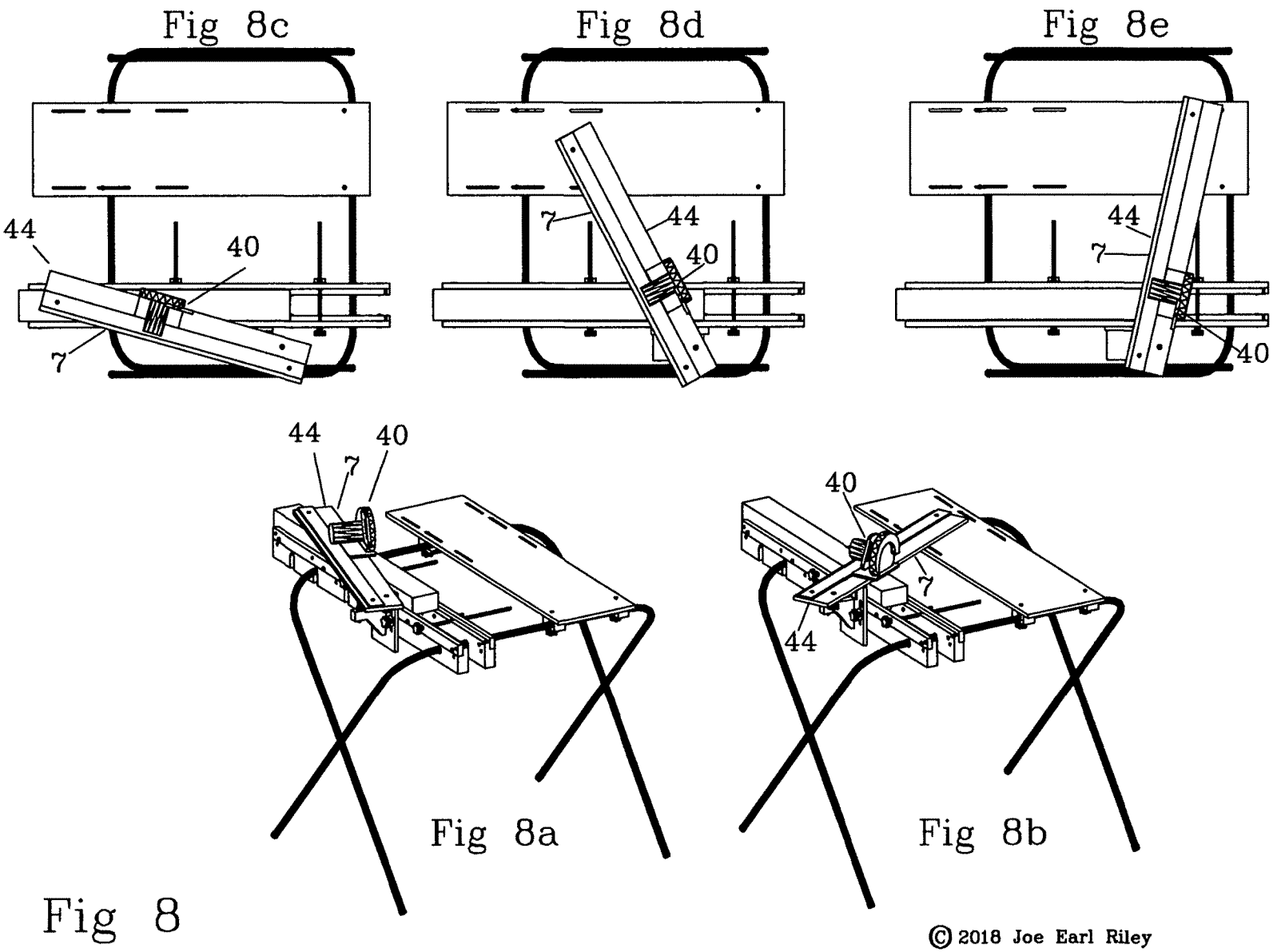

Referring to FIG. 8 which comprises FIGS. 8*a* through 8*e*, a variety of angular cuts is achievable. Shown are said saw guide assembly 7 with the slide surface 44 with said miter saw 40 in various orientations.

The clamping rail assemblies 4, 5 each of which comprise a clamping rail base 13 with a sacrificial rail 12 set in a top edge notch 22 and affixed to each of the clamping rail bases 13 by means of bolts 14 and nuts 18, and a bushing 16 (Ref. FIGS. 4*d* and 4*e*).

The clamping rail base 13 comprises the top edge notch 22, an aperture 15 and notches 17 (Ref. FIGS. 4*d* and 4*e*).

Either of the support legs 2, 3 is inserted through the bushing 16 in clamping rail base 13.

One of the notches 17 each of the clamping rail bases 13 is placed over the other support leg 3, 2, locking the support legs 2, 3, in position.

Multiple notches 17 allows for height adjustments of said apparatus 1.

Rotation of the legs 2, 3, with respect to each other, about the pin 2*a* plus multiple notches 17 allows for height adjustments of the apparatus 1.

The bushing 16 is a replaceable bushing and is used to minimize wear on the legs 2, 3.

Referring to FIG. 3 which comprises FIGS. 3*a* through 3*d*, work pieces 20 and 21 each can rest as shown in FIGS. 3*c* and 3*d* on the clamping rail bases 13 between the sacrificial rails 12 (Ref also FIGS. 4*a* through 4*e*). The cut-to-length rod assembly 9 allows for the wider work piece 20 while the standard length all thread rod assembly 8 is a standard length for typical thinner work pieces. Referring to FIG. 4*b*, clamping rails 4, 5 are shown. Referring to FIG. 3*a*, a view of the clamping rails 4, 5 installed on the support legs 2, 3 is shown.

Referring also to FIGS. 4*a*, 4*c* and 4*f*, the standard length all thread rod assembly 8 comprises a standard length all thread rod 8*a* and a hand knob 10 and a quick acting hand knob 11.

In FIG. 2 a cut-to-length all thread rod assembly 9 comprises a cut-to-length all thread rod 9*b* (Ref. also FIG. 4*f*) with the hand knob 10 and the quick acting hand knob 11.

Either of the rods 8*a* or 9*b* is inserted through apertures 9*a*. Clamping of work pieces 20, 21 (Ref. FIGS. 3*a* through 3*d*) is attained by means of either of the rod assemblies 8 or 9 which are resting on the clamping rail bases 13 between the sacrificial rails 12.

Also, a drill press (not shown) can be mounted on clamping rail assemblies 5, 6 of the apparatus 1 for drilling, boring and reaming operations as well as other tools for other operations, such as, but not restricted to, a planer (not shown) or a sander (not shown).

FIG. 9 comprising FIGS. 9*a* and 9*b* illustrates said saw 40 used as a chop saw with the assembly 1.

FIG. 10 comprising FIGS. 10*a*; 10*b*, and 10*c* contrast conventional saw horses 51 (Ref. FIG. 10*a*) for holding a 4*x*8 plywood sheet 52 and the use of the assembly 1 to hold the plywood sheet 52 (Ref. FIGS. 10*b* and 10*c*).

Although the descriptions above contain many specificities, these should not be construed as limiting the scope of the invention, but as merely providing illustrations of some of the preferred embodiments of the present invention.

It will be obvious to those skilled in the art that modifications may be made to the embodiments described above without departing from the scope of the present invention. Thus the scope of the invention should be determined by the appended claims in the formal application and their legal equivalents, rather than by the examples given.

I claim:

1. A saw horse comprising:

pivotal support legs with a pivot pin; and at least one pair of clamping rail assemblies;

a saw guide assembly comprising:

a base assembly, an attachment bolt, a hand tightening knob, saw guide attachment bolts, a saw guide, a slide surface, an adjusting bolt, and an adjustment hand nut;

wherein the rail assemblies are hinged on the support legs at one end and have multiple notches that can be used to secure the rail assemblies on the opposing support legs;

wherein rotation of the support legs on which the rail assemblies are hinged with respect to each other about the pivot pin plus securing the rail assemblies with the notches to the opposing support legs allows for height adjustment of the saw horse;

wherein the attachment bolt, through an aperture in one of the clamping rail assemblies, attaches, in conjunction with the hand tightening knob, the saw guide assembly to the one of the clamping rail assemblies;

wherein the saw guide attachment bolts attach the saw guide to the slide surface;

wherein the adjusting bolt is used in conjunction with the adjustment hand nut to adjust orientation of the saw guide with respect to one of the clamping rail assemblies;

wherein the slide surface comprises slide slots so as to permit placement of the saw guide as required to adjust for a variety of saws; and wherein a saw slides on the slide surface guided by the saw guide;

wherein the base assembly comprising:

a base plate with pivot pin holes, an attachment plate, a hinge, a swing arm, a leveling bolt;

wherein the hinge connects the base plate to the attachment plate;

wherein a pivot pin of the saw guide assembly inserts through the pivot pin holes and through the swing arm;

wherein the leveling bolt is used to precision level a tool surface; and wherein the attachment plate has a clearance for a hand tightening knob.

2. The saw horse of claim 1 further comprising a work surface with encompassing clamps and open ended clamps for clamping the work surface on the support legs.

3. A combination saw horse and clamping work bench with saw guide comprising:

pivotal support legs with a pivot pin, and at least one pair of clamping rail assemblies, wherein the clamping rail assemblies are hinged on the pivotal support legs at one end of each of the clamping rail assemblies and secured to the opposing support legs by notches contained in each of the clamping rail assemblies to clamp the work bench in position;

an attachment bolt configured to attach the saw guide assembly to the one of the clamping rail assemblies; said saw guide assembly including a slide surface appropriately attached to the saw guide, the slide surface comprising slide slots so as to permit placement of the saw guide as required to adjust for a variety of saws;

a base assembly comprising:

a base plate with pivot pin holes, an attachment plate, a base hinge, a swing arm, a leveling bolt;

wherein the base hinge connects the base plate to the attachment plate;

wherein a pivot pin inserts through the pivot pin holes and through the swing arm:

wherein the leveling bolt is used to precision level a tool surface; and wherein the attachment plate has a clearance for a hand tightening knob.

4. The combination saw horse and clamping work bench with saw guide of claim 3, wherein the work bench comprising a work surface with encompassing clamps and open ended clamps for clamping the work surface on the support legs.

* * * * *